US008479655B1

(12) United States Patent
Gamache et al.

(10) Patent No.: US 8,479,655 B1
(45) Date of Patent: Jul. 9, 2013

(54) PROJECTILE SYSTEM AND METHOD FOR IMPEDING VESSEL MOVEMENT

(75) Inventors: Raymond M. Gamache, Indian Head, MD (US); Jeffrey Michael Emenheiser, Felton, PA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/373,244

(22) Filed: Nov. 8, 2011

(51) Int. Cl.
*F42B 12/46* (2006.01)

(52) U.S. Cl.
USPC ..... 102/501; 102/502; 102/370; 89/1.11; 89/1.1

(58) Field of Classification Search
USPC ..... 102/367, 368, 369, 370, 501, 502, 102/512, 513; 89/1.1, 1.11
See application file for complete search history.

(56) References Cited

U.S. PATENT DOCUMENTS

| | | | | |
|---|---|---|---|---|
| 3,725,156 | A * | 4/1973 | Thompson | 149/81 |
| 6,170,399 | B1 * | 1/2001 | Nielson et al. | 102/336 |
| 6,591,774 | B2 | 7/2003 | Metherell et al. | 114/241 |

FOREIGN PATENT DOCUMENTS

DE 4343502 A1 * 8/1994

* cited by examiner

*Primary Examiner* — James Bergin
(74) *Attorney, Agent, or Firm* — Gerhard W. Thielman, Esq.

(57) ABSTRACT

A projectile system for impeding vessel movement is provided. The system includes a projectile device that contains a superoxide material for generating an exothermic reaction when exposed to water. At termination of flight, the projectile releases the superoxide material into the surrounding water. A delay can be set to enable the projectile to release its payload underneath the water surface, creating both a disturbance in the water and large gas bubbles to affect the trajectory of the target surface vessel.

11 Claims, 1 Drawing Sheet

PROJECTILE SYSTEM AND METHOD FOR IMPEDING VESSEL MOVEMENT

STATEMENT OF GOVERNMENT INTEREST

The invention described herein was made in the performance of official duties by one or more employees of the Department of the Navy, and the invention herein may be manufactured, practiced, used, and/or licensed by or for the Government of the United States of America without payment of any royalties thereon or therefor.

BACKGROUND

The invention relates generally to projectiles, and more particularly to a projectile system and method for impeding vessel movement on a water's surface.

Conventional methods and devices for impeding the movement of small surface vessels include deployable nets designed to foul the propeller mechanism of a vessel, fences, and fixed barriers. While generally effective at stopping small surface vessels, all are limited in terms of flexibility due to their small area of effect.

Accordingly Stationary barriers take time to set up and restrict both desirable and undesirable maritime traffic, and are passive defenses. Deployable nets, either shot from some launching apparatus or dropped into the water by a boat or aircraft, have limited range, cover a limited area, and require the target vessel to collide with the nets in order to be effective. Without any of these nonlethal options, lethal force can be used, but is much more prone to uncertainty. Moreover, net systems have negligible effect on surface vessels powered by jet propulsion systems.

SUMMARY OF THE INVENTION

Accordingly, various exemplary embodiments provide a method and a system that can be used to effectively and non-lethally impede movement of a vessel on the surface of water. Other objects and advantages of various exemplary embodiments will become more obvious hereinafter in the specification and drawings.

In accordance with the various exemplary embodiments, a projectile system and method are provided for impeding vessel movement. The projectile system includes a superoxide material for generating an exothermic reaction when exposed to water. A device contains the superoxide material during a projectile flight thereof. The device also supports release of the superoxide material into a surrounding environment upon completion of the projectile flight.

BRIEF DESCRIPTION OF THE FIGURES

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF EXEMPLARY EMBODIMENTS

Figure 1:
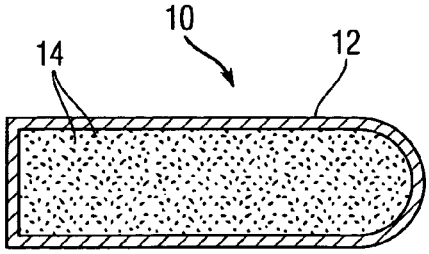
FIG. 1 is a cross-sectional view of a projectile system for impeding vessel movement in accordance with an embodiment of the present invention.

Referring now to the drawings and more particularly to FIG. 1, a projectile system that can be used to impede movement of a surface or floating vessel (not shown) is illustrated and is referenced generally by numeral 10. As used herein, the term "floating vessel" refers generally to relatively small (i.e., generally on the order of 40 feet or less in length) boats that can be manned or unmanned. Further, the phrase "impede movement" as used herein contemplates a variety of non-lethal outcomes ranging from simple course disruption to capsizing of the vessel. However, it is to be understood that both the size of the floating vessel and the type of movement impediments generated by embodiments of the projectile system are not limitations of the present invention.

Projectile system 10 includes a casing 12 that is at least partially filled with a superoxide material 14. As is known in the art, superoxide materials (e.g., potassium superoxide ($KO_2$), sodium superoxide ($NaO_2$)) are a class of materials that exothermally react with both fresh and salt water environments. More specifically, the exothermic reaction is very fast and generates heat and gas such that a gas bubble(s) are readily generated as a result of the reaction. Control of the reaction rate can be achieved via particle size, packing density, and the rate that superoxide material 14 is dispersed in the water environment. In the illustrated embodiment, superoxide material 14 is in a particle or powder form to maximize reaction surface area when dispersed from casing 12.

Casing 12 is generally shaped to be aerodynamically stable in a ballistic sense. That is, casing 12 is generally shaped as a projectile that can be fixed or launched from a barrel or launcher, and then fly through the air in an aero-dynamically stable fashion for delivery to a specified/aimed location as will be explained further below. In addition, casing 12 will generally be made completely or partially from a material that will fracture when receiving an impact force (e.g., when casing 12 strikes a target, when something within casing 12 generates a pressure wave pushing out on casing 12, etc.). For example, casing 12 can be made completely or partially from a frangible material (e.g., plastic) that readily fractures when casing 12 is subject to an impact force.

Figure 2:
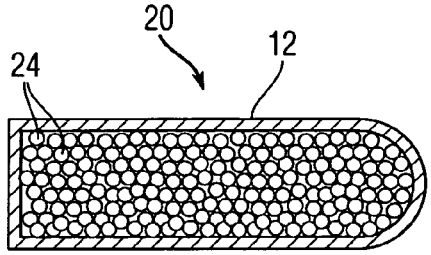
FIG. 2 is a cross-sectional view of a projectile system for impeding vessel movement in accordance with another embodiment of the present invention.

The projectile system of the present invention is not limited to using a powdered superoxide material 14. For example, FIG. 2 illustrates another projectile system 20 in which casing 12 is completely or partially filled with pellets 24 of superoxide material. Pellets 24 might be used to generate a slower but longer-lasting reaction when casing 12 fractures/ruptures thereby dispersing pellets 24 into a surrounding environment.

Figure 3:
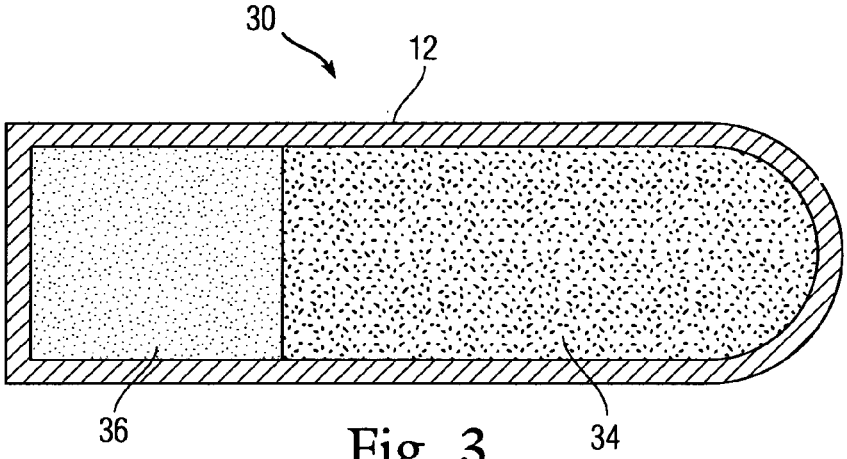
FIG. 3 is a schematic view of a projectile system for impeding vessel movement in accordance with yet another embodiment of the present invention.

As mentioned above, the projectile system of the present invention can be configured to generate its own casing rupturing force that will also function to disperse the superoxide material contained therein. Accordingly, FIG. 3 illustrates another projectile system 30 in which casing 12 encases both super-oxide material 34 (e.g., in powdered form, pelletized form, etc.) and a device 36 designed to expel/disperse superoxide material 34 from casing 12. For example, device 36 could be configured similar to an automobile airbag initiator that generates a rapid pressure wave that will cause casing 12 to fracture while also dispersing superoxide material 34 into a surrounding environment.

Figure 4:
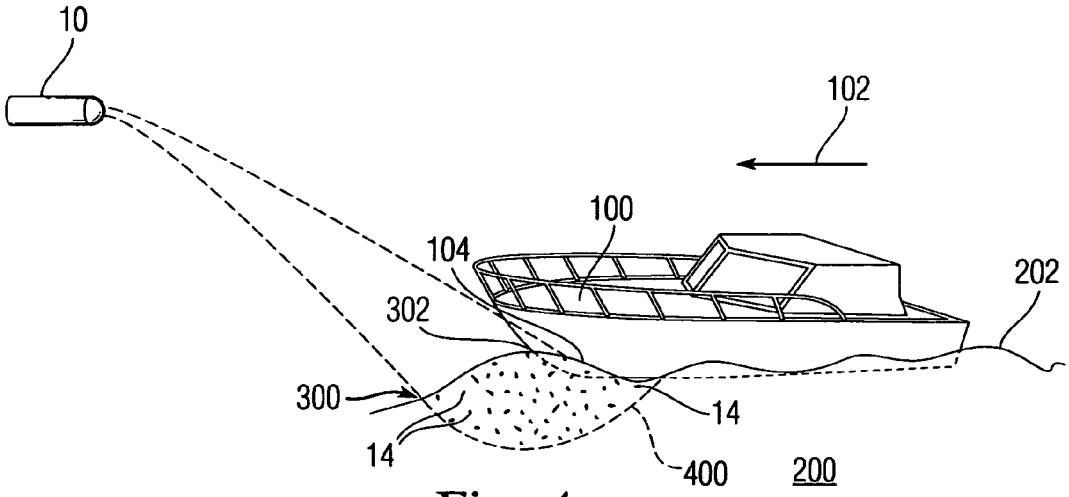
FIG. 4 depicts an operational scenario of the method for impeding vessel movement in accordance with an embodiment of the present invention.

A method of using the projectile system of the present invention to impede movement of a vessel will now be explained with the aid of FIG. 4. For simplicity, FIG. 4 illustrates the use of a single projectile system (e.g., projectile system 10). However, it is to be understood that a plurality of projectile system 10 can be utilized in an operational scenario without departing from the scope of the present invention. In FIG. 4, a vessel 100 is shown floating at the surface 202 of a body of water 200. Vessel 100 can be traveling in the direction indicated by arrow 102.

In accordance with the present invention, projectile system 10 is launched or otherwise propelled to a location 300 that can be just forward of vessel 100 or a location 302 that targets vessel 100 at or near the waterline 104 thereof. Obviously, if more than one projectile system 10 is being used, both location 300 and location 302 could be selected or targeted. Once reaching its selected or targeted location, the casing of projectile system 10 fractures as described above to thereby disperse superoxide material 14 in water 200 around locations 300 and/or 302. (For sake of clarity, the fractured pieces of the casing are not illustrated in FIG. 4.) The dispersed superoxide material 14 reacts with water 200 to quickly generate heat and gas that causes a gas bubble 400 to form in water 200. The presence of gas bubble 400 impedes the movement of vessel 100 by, for example, disrupting its course, rocking vessel 100, or capsizing vessel 100.

The advantages of the present invention are numerous. The non-lethal projectile system can be used to specifically target suspicious vessels traveling along the surface of the water. The number of projectile systems used can be selected predicated on the suspected threat level. Since the exothermic reaction provided by the superoxide materials is rapid, the effectiveness of the present invention can be readily gauged so that a more lethal deterrent can be employed if necessary.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

The invention claimed is:

1. A projectile system, comprising:

a superoxide material for generating an exothermic reaction when exposed to water; and a device for containing said superoxide material during a projectile flight thereof, and for supporting release of said superoxide material into a surrounding environment upon completion of said projectile flight.

2. The projectile system as in claim 1, wherein said superoxide material is selected from the group consisting of potassium superoxide and sodium superoxide.

3. The projectile system as in claim 1, wherein said superoxide material is in powdered form.

4. The projectile system as in claim 1, wherein said superoxide material is in pelletized form.

5. The projectile system as in claim 1, wherein said device comprises a frangible ballistic casing.

6. The projectile system as in claim 1, wherein said device comprises:

a ballistic casing; and an expulsion device supported within said ballistic casing for expelling said superoxide material from said ballistic casing and into the surrounding environment.

7. A projectile system, comprising:

a ballistic casing; and a material selected from the group consisting of potassium superoxide and sodium superoxide, said material at least partially filling said ballistic casing.

8. The projectile system as in claim 7, wherein said ballistic casing is made at least partially from a material adapted to fracture upon receiving an impact force.

9. The projectile system as in claim 7, wherein said material comprises a powdered form thereof.

10. The projectile system as in claim 7, wherein said material comprises a pelletized form thereof.

11. The projectile system as in claim 7, further comprising an expulsion device supported within said ballistic casing for expelling said superoxide material from said ballistic casing and into a surrounding environment.

* * * * *